US006463233B2

(12) United States Patent
Kojima et al.

(10) Patent No.: US 6,463,233 B2
(45) Date of Patent: Oct. 8, 2002

(54) PROCESS CARTRIDGE HAVING FIRST AND SECOND CARTRIDGE GUIDING PORTIONS AND AN ELECTROPHOTOGRAPHIC IMAGE FORMING APPARATUS TO WHICH THE PROCESS CARTRIDGE IS ATTACHED

(75) Inventors: Hisayoshi Kojima, Mishima; Hironobu Isobe, Numazu; Atsushi Numagami, Hadano; Kazunari Murayama, Shizuoka-ken; Nobuharu Hoshi, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/782,280

(22) Filed: Feb. 14, 2001

(65) Prior Publication Data

US 2001/0028811 A1 Oct. 11, 2001

(30) Foreign Application Priority Data

Feb. 16, 2000 (JP) ..... 2000-037826

(51) Int. Cl.[7] ..... G03G 21/18
(52) U.S. Cl. ..... 399/111; 399/113
(58) Field of Search ..... 399/107, 110, 399/111, 113

(56) References Cited

U.S. PATENT DOCUMENTS 5,235,383 A 8/1993 Tada et al.
5,249,026 A 9/1993 Kojima
5,283,616 A 2/1994 Numagami et al.
5,331,373 A 7/1994 Nomura et al.
5,383,011 A 1/1995 Numagami et al.
5,442,421 A 8/1995 Kojima et al.
5,452,056 A 9/1995 Nomura
5,471,284 A 11/1995 Fuji et al.
5,497,220 A 3/1996 Inomata et al.
5,500,714 A 3/1996 Yashiro et al.
5,521,693 A 5/1996 Kojima et al.
5,543,898 A 8/1996 Shishido et al.
5,585,889 A 12/1996 Shishido et al.
5,585,895 A 12/1996 Yashiro et al.
5,617,579 A 4/1997 Yashiro et al. ..... 399/114
5,689,774 A 11/1997 Shishido et al. ..... 399/111
5,740,499 A 4/1998 Higeta et al. ..... 399/105
5,745,823 A 4/1998 Goto et al.
5,768,658 A 6/1998 Watanabe et al. ..... 399/111
5,790,923 A 8/1998 Ogama et al. ..... 399/106
5,809,374 A 9/1998 Tsuda et al. ..... 399/111
5,920,753 A 7/1999 Sasaki et al. ..... 399/111
5,937,239 A 8/1999 Watanabe et al. ..... 399/111
5,937,240 A * 8/1999 Kanno et al. ..... 399/111
5,937,242 A 8/1999 Yokoyama et al. ..... 399/114
5,940,657 A 8/1999 Yokomori et al. ..... 399/119
5,963,759 A 10/1999 Kojima et al. ..... 399/111

(List continued on next page.)

*Primary Examiner*—Hoang Ngo
(74) *Attorney, Agent, or Firm*—Fitzpatrick, Cella, Harper & Scinto

(57) ABSTRACT

A process cartridge detachably mountable to a main assembly of an electrophotographic image forming apparatus includes a cartridge frame; an electrophotographic photosensitive member; a process device actable on the photosensitive member, a first cartridge guiding portion for being guided by a main assembly guide provided in the main assembly of the apparatus when the process cartridge is mounted to the main assembly of the apparatus, the first cartridge guiding portion being provided at one end, with respect to a mounting direction in which the process cartridge is mounted to the main assembly of apparatus of the cartridge frame; and a second cartridge guiding portion for being guided by the main assembly guide provided in the main assembly of the apparatus when the process cartridge is mounted to the main assembly of apparatus, the second cartridge guiding portion being provided at the other end, with respect to the mounting direction, of the cartridge frame, wherein when the process cartridge is mounted to the main assembly of the apparatus, the first and second cartridge guiding portions are at different heights.

16 Claims, 13 Drawing Sheets

U.S. PATENT DOCUMENTS

| | | | | |
|---|---|---|---|---|
| 5,966,566 | A | 10/1999 | Odagawa et al. | 399/109 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,064,843 | A | 5/2000 | Isobe et al. | 399/111 |
| 6,072,969 | A | 6/2000 | Yokomori et al. | 399/119 |
| 6,078,763 | A | 6/2000 | Hoshi | 399/111 |
| 6,097,908 | A | 8/2000 | Uchiyama et al. | 399/111 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,131,007 | A | 10/2000 | Yamaguchi et al. | 399/256 |
| 6,131,011 | A | 10/2000 | Kojima et al. | 399/351 |
| 6,157,792 | A | 12/2000 | Mori et al. | 399/24 |
| 6,169,866 | B1 | 1/2001 | Watanabe et al. | 399/111 |

* cited by examiner

PROCESS CARTRIDGE HAVING FIRST AND SECOND CARTRIDGE GUIDING PORTIONS AND AN ELECTROPHOTOGRAPHIC IMAGE FORMING APPARATUS TO WHICH THE PROCESS CARTRIDGE IS ATTACHED

FIELD OF THE INVENTION AND RELATED ART

The present invention relates to an electrophotographic image forming apparatus, and a process cartridge removably mountable in the main assembly of an electrophotographic image forming apparatus.

Here, an electrophotographic image forming apparatus means an apparatus which forms an image on recording medium with the use of an electrophotographic image formation process. It includes, for example, an electrophotographic copying machine, an electrophotographic printer (for example, a laser beam printer, LED printer, and the like), a facsimile apparatus, a word processor, and the like.

A process cartridge means a cartridge in which a charging means, a developing means or a cleaning means, and an electrophotographic photosensitive member, are integrally placed, and which is removably mountable in the main assembly of an image forming apparatus. It also means a cartridge in which at least one processing means among a charging means, a developing means, and a cleaning means, and an electrophotographic photosensitive member, are integrally placed, and which is removably mountable in the main assembly of an image forming apparatus, and a cartridge in which at least a charging means and an electrophotographic photosensitive member, are integrally placed, and which is removably mountable in the main assembly of an image forming apparatus.

Conventionally, an image forming apparatus which employs an electrophotographic image formation process also employs a process cartridge system. According to a process cartridge system, an electrophotographic photosensitive member, and a single or plural processing means, which act on an electrophotographic photosensitive member, are integrally placed in a cartridge which is removably mountable in the main assembly of an image forming apparatus. Also according to this process cartridge system, an image forming apparatus can be maintained by users themselves without relying on service personnel, and therefore, operational efficiency can be drastically improved. As a result, a process cartridge system is widely used in the field of the image forming apparatus.

In order to make it easier to removably mount the aforementioned process cartridge in the main assembly of an image forming apparatus, it is customary that the image forming apparatus main assembly is provided with a pair of guide rails, which are located on each side of the apparatus main assembly, one for one, with respect to the direction in which the process cartridge is inserted, whereas the process cartridge is provided with a pair of guide ribs, which are located at the locations corresponding to the aforementioned guide rails on the apparatus main assembly side.

It has been known that a multicolor image forming apparatus, in which a plurality of process cartridges different in color of the developer they contain are removably mounted in parallel to form a multicolor image, is available. It has also been known that the provision of guide rails and guide ribs such as the those described above makes it easier to removably mount the process cartridges even in this type of a multicolor image forming apparatus.

When this type of structure is adopted, if the guide rails on the left and right sides are at the same level, it is possible that a process cartridge will be reversely inserted into the apparatus main assembly, with respect to the front and back sides in terms of the cartridge-insertion direction.

In addition, in the case of the aforementioned multicolor image forming apparatus, it is necessary to provide a wider space between the adjacent two cartridges in order to prevent the guide ribs of the adjacent two process cartridges, and the guide rails which support these guide ribs, from interfering with each other. This makes it difficult to reduce apparatus size.

The present invention is a result of the further development of the above described prior technologies.

SUMMARY OF THE INVENTION

The primary object of the present invention is to provide a process cartridge smoothly mountable in the main assembly of an electrophotographic image forming apparatus, and an electrophotographic image forming apparatus in which such a process cartridge is removably mountable.

Another object of the present invention is to provide a process cartridge mountable in the main assembly of an electrophotographic image forming apparatus without causing a directional mistake concerning the front and rear sides of the process cartridge in terms of the process cartridge insertion direction, and an electrophotographic image forming apparatus in which such a process cartridge is removably mountable.

Another object of the present invention is to provide a process cartridge configured to reduce the space necessary between two adjacent process cartridges when a plurality of process cartridges are horizontally mounted in parallel in the main assembly of an electrophotographic image forming apparatus, and an electrophotographic image forming apparatus in which such a process cartridge is removably mountable.

Another object of the present invention is to provide a process cartridge, the guide portions of which and the guide portions of adjacent process cartridges permitting vertical stacking of a plurality of process cartridges when they are horizontally mounted in parallel in the main assembly of an electro-photographic image forming apparatus, and an electrophotographic image forming apparatus in which such a process cartridge is removably mountable.

According to an aspect of the present invention, there is provided a process cartridge detachably mountable to a main assembly of an electrophotographic image forming apparatus, comprising a cartridge frame; an electrophotographic photosensitive member; process means actable on said photosensitive member; a first cartridge guiding portion for being guided by a main assembly guide provided in the main assembly of the apparatus when the process cartridge is mounted to the main assembly of the apparatus, the first cartridge guiding portion being provided at one end, with respect to a mounting direction in which the process cartridge is mounted to the main assembly of apparatus of the cartridge frame; and a second cartridge guiding portion for being guided by the main assembly guide provided in the main assembly of the apparatus when the process cartridge is mounted to the main assembly of apparatus, the second cartridge guiding portion being provided at the other end, with respect to the mounting direction, of the cartridge frame, wherein when the process cartridge is mounted to the main assembly of the apparatus, the first and second cartridge guiding portions are at different heights.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

In the following description of the present invention, the longitudinal direction means a direction that is perpendicular to the recording-medium-conveyance direction, and is parallel to the surface of the recording medium being conveyed. The terms "left" and "right" refer to the left and right of the recording medium being conveyed, as seen from the above and trailing side of the recording medium. The top side of a process cartridge refers to the top side of a process cartridge, which is properly mounted in the main assembly of an image forming apparatus.

Figure 1:
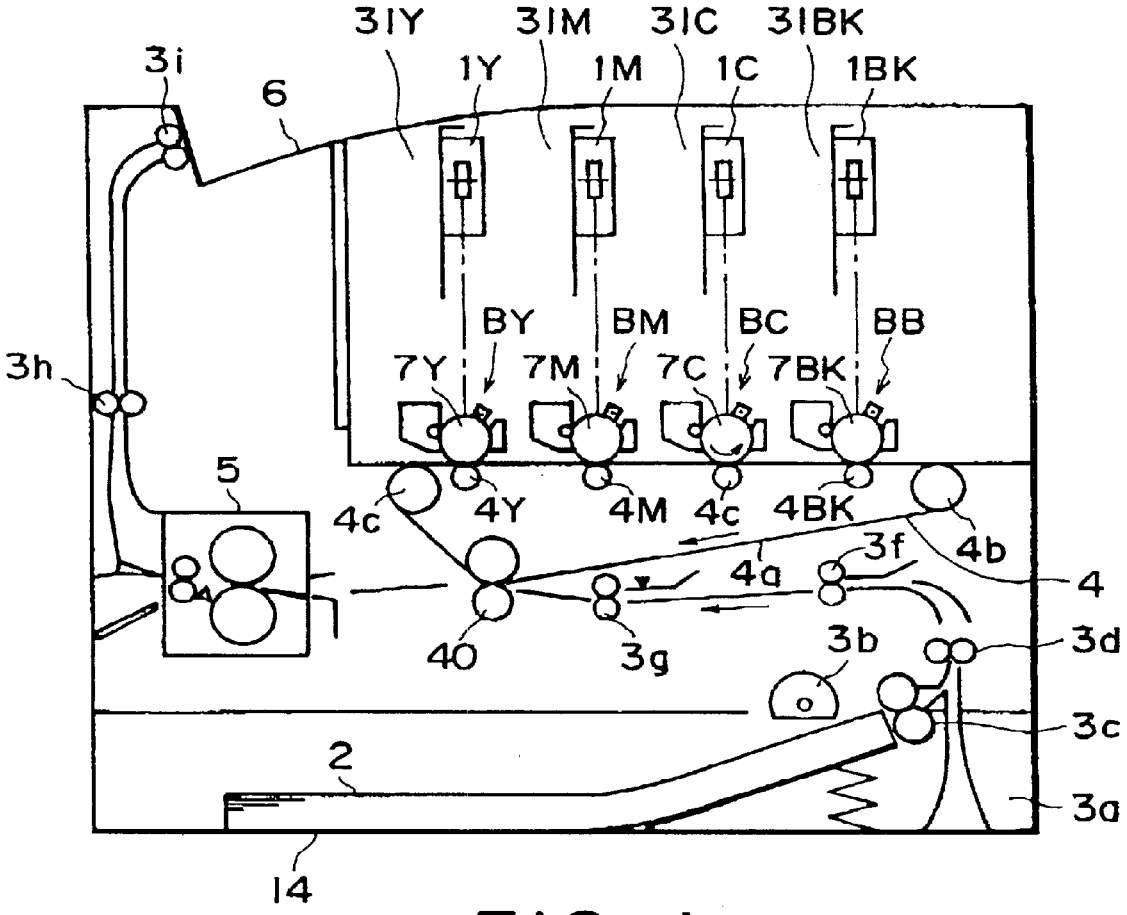
FIG. 1 is a vertical sectional view of an electrophotographic image forming apparatus.

FIG. 1 is a drawing showing an image forming apparatus in accordance with the present invention. This image forming apparatus comprises: image forming portions 31Y, 31M, 31C, and 31BK for forming a toner image on the correspondent photosensitive drums as image bearing members; an intermediary transfer belt 4*a* onto which the toner images on the photosensitive drums are temporarily transferred; a secondary transfer roller 40 as a transferring means for transferring the toner images on the intermediary transfer belt 4*a* onto a recording medium 2; a sheet feeding means for sending the recording medium 2 between the intermediary transfer belt 4*a* and secondary transfer roller 40*p*; a conveying means for conveying recording medium 2 to the transferring means; a fixing means; and a sheet discharging means.

Hereinafter, image formation will be described.

Referring to FIG. 1, in the image forming apparatus, a sheet feeding cassette 3*a* containing in layers plural sheets of recording medium 2 (for example, recording paper, OHP sheet, fabric, and the like) is removably mounted. After being fed out of the sheet feeding cassette 3*a* by a pickup roller 3*b*, the recording medium sheets 2 are separated one by one from the rest of them by a retarding roller pair 3*c*, and are conveyed to a registering roller pair 3*g* by conveying roller pairs 3*d* and 3*f*.

When the recording medium sheet 2 arrives, the registering roller pair 3*g* is stationary, and if the recording medium sheet 2 is being conveyed askew, it is straightened by bumping into the nip of the registering roller pair 3*g*.

In the case of a four drum type full-color system, a process cartridge BY which develops a latent image with the use of yellow developer, a process cartridge BM which develops a latent image with the use of magenta developer, a process cartridge BC which develops a latent image with the use of cyan developer, and a process cartridge BB which develops a latent image with the use of black toner, are placed side by side and in parallel. Further, optical scanning systems 1Y, 1M, 1C, and 1BK are positioned corresponding to the cartridges BY, BM, BC, and BB. A toner image is formed on the photosensitive drum in each of the four process cartridges BY, BM, BC, and BB. Thereafter, four toner images, that is, one on each of the four photosensitive drums, are transferred in layers onto the Intermediary transfer belt 1*a* running in the direction indicated by an arrow mark in the drawing, by transfer rollers 4Y, 4M, 4C, and 4BK, correspondingly.

Thereafter, the recording medium sheet 2 is delivered to the secondary transfer roller 40 with a predetermined timing, and the toner images on the intermediary transfer belt 4*a* are transferred onto the recording medium sheet 2. Next, the toner images are fixed to the recording medium sheet 2, in the fixing apparatus 5. Then, the recording medium sheet 2 is discharged from the apparatus main assembly by sheet discharging roller pairs 3h and 3i, into a delivery tray 6 on top of the apparatus main assembly 14.

The aforementioned image forming portions 31Y, 31M, 31C, and 31BK, exclusive of their optical scanning systems 1Y, 1M, 1C, and 1BK, are parts of corresponding cartridges BY, BM, BC, and BB. Since all the process cartridges are the same in structure, the cartridge structure will be described with reference to the process cartridge BY.

Figure 2:
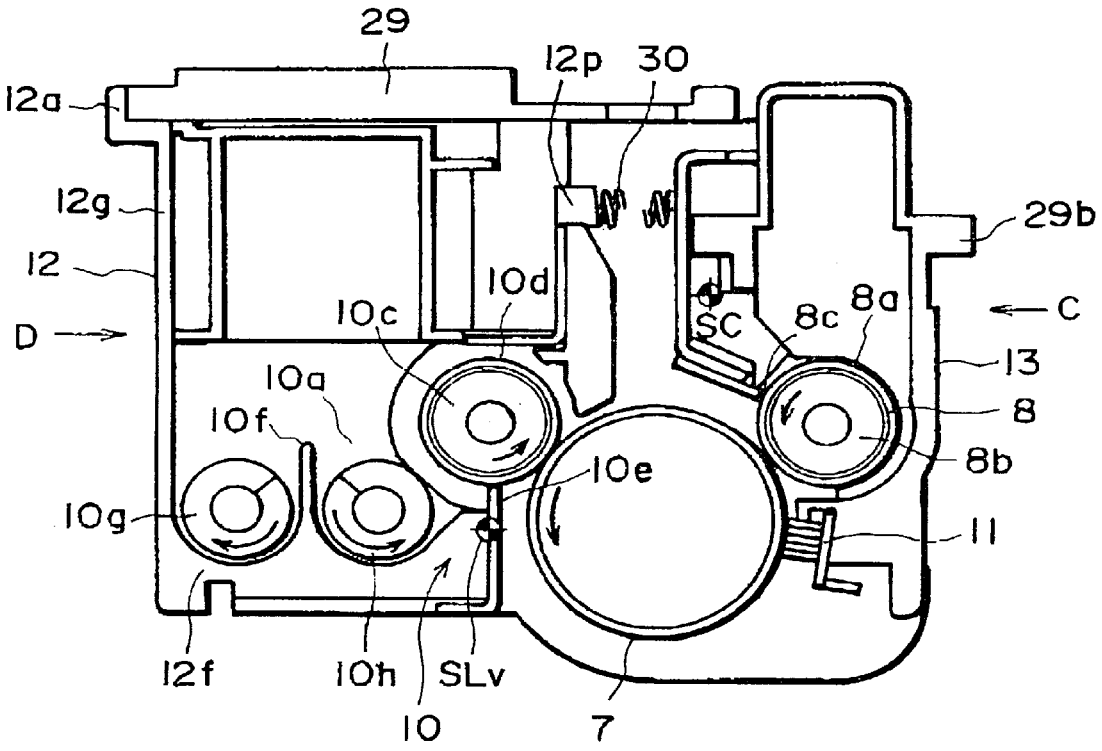
FIG. 2 is a vertical sectional view of a process cartridge.

Referring to FIG. 2, in the process cartridge BY, a charging means, an exposing means, a developing means, and a transfer opening, are placed in a manner to surround the peripheral surface of the photosensitive drum 7. In this embodiment, two component developer, which contains magnetic carrier particles, is used. As for the photosensitive drum 7 employed in this embodiment, an ordinary organic photosensitive member or the like may be employed. However, it is preferable to employ a photosensitive member, which has an organic photosensitive base member, and a surface layer formed of such material having electrical resistance in a range of $10^2$–$10^{14}$ Ω·c m, a photosensitive member based on amorphous silicon, and the like, because the employment of any of such photosensitive members makes it possible to realize charge injection, which is effective to prevent ozone generation, and also to reduce power consumption, as well as to improve charging performance.

Thus, in this embodiment, the photosensitive drum 7 comprising an aluminum drum as a base drum, and a layer of negatively chargeable organic photosensitive material coated on the peripheral surface of the base drum, is employed.

The charging means in this embodiment is a magnetic brush type charging device 8 which employs magnetic carrier.

This charging device 8 comprises a rotationally supported hollow and cylindrical charge roller 8*a*, and a stationary magnet 8*b* fixed within the charge roller 8*a*. After image transfer, the toner remaining on the photosensitive drum 7 is taken into the charging device 8, the charge roller 8*a* of which rotates in the direction indicated by an arrow mark.

The developing apparatus in this embodiment employs a method in which two component developer is placed in contact with the peripheral surface of the photosensitive drum 7 (two component developer based non-contact development).

FIG. 2 shows the developing means 10 used in this embodiment. This developing means 10 is based on a two component based magnetic brush. The development sleeve 10*d* is a hollow cylinder, and is rotationally supported. Within the development sleeve 10*d*, a magnet 10*c* is stationarily fixed. The development sleeve 10*d* rotates in the same direction as the photosensitive drum 7, and thus, in the area in which the distance between the peripheral surfaces of the development sleeve 10*d* and photosensitive drum 7 is smallest, the peripheral surface of the development sleeve 10*d* moves in the direction opposite to the moving direction of the peripheral surface of the photosensitive drum 7. The photosensitive drum 7 and development sleeve 10*d* are positioned to leave a gap in a range of 0.2–1.0 mm between their peripheral surfaces, so that developer makes contact with the peripheral surface of the photosensitive drum 7 to develop a latent image on the photosensitive drum 7.

Toner mixed with carrier is placed in a casing partitioned with a partitioning wall 10*f*. The partitioning wall 10*f* is not in contact with the front and rear casing walls, and therefore, a gap is provided between each of the longitudinal ends of the partitioning wall and the corresponding walls of the casing. The toner mixed (hereinafter, simply "toner") with carrier is moved by stirring screws 10*g* and 10*h* in the casing. More specifically, the toner is allowed to fall to the adjacencies of one end of the stirring screw 10*g*, and then is conveyed in the longitudinal direction thereof, while being stirred, to the other end of the stirring screw 10*g*. Then, the toner is moved into the other side of the partitioning wall 10*f* through the aforementioned gap between the longitudinal end of the partition wall 10*f* and the corresponding wall of the casing, and is moved by the stirring screw 10*h* to the other side, or the side where it fell. Then, the toner is moved to the other side through the another gap between the longitudinal end of the partition wall 10*f* and the corresponding casing wall, to be conveyed again by the stirring screw 10*g* to the opposite longitudinal end of the casing, while being stirred. In other words, the toner is circulated in the casing by the stirring screws 10*g* and 10*h*.

Next, a development process in which an electrostatic latent image formed on the photosensitive drum 7 is developed into a visible image by the magnetic brush based developing apparatus 10, and a developer circulating system, will be described.

First, as the development sleeve 10*d* is rotated, developer is picked up and placed upon the peripheral surface of the development sleeve 10*d* by one of the magnetic poles of the magnet 10*c*. Then, as the development sleeve 10*d* is rotated further, the layer of the developer on the development sleeve 10*d* is regulated in thickness by a regulating blade 10*e* positioned perpendicular to the peripheral surface of the development sleeve 10*d*. As a result, a thin layer of the developer is formed on the peripheral surface of the development sleeve 10*d*. As the thin layer of the developer reaches the position corresponding to the position of the primary development pole of the magnet 10*c*, the developer is caused to gather in the form of a broom tip, by the magnetic force. The electrostatic latent image on the photosensitive drum 7 is developed by the developer which has gathered in the form of a broom tip. After the development of the electrostatic latent image, the developer on the development sleeve 10*d* is returned to the developer container 10*a* by the repulsive magnetic field.

To the development sleeve 10*d*, DC voltage and AC voltage are applied from an unillustrated power source. Generally speaking, in a two component developer based developing method, application of AC voltage increases development efficiency, thereby improving image quality. However, the application of AC voltage tends to result in a foggy image. Therefore, in order to prevent toner from adhering to the non-image areas of the peripheral surface of the photosensitive drum 7 during a developing process, a difference in potential level is provided between the DC voltage applied to the development sleeve 10*d* and the electrical charge on the peripheral surface of the photosensitive drum 7.

The thus obtained toner image is transferred by an intermediary transferring apparatus 4 onto an intermediary transfer belt 4*a* as an intermediary transfer medium. The intermediary transferring apparatus 4 comprises a driver roller 4*b*, a follower roller 4*c*, and a secondary transfer counter roller 4*d*, and an endless belt 4*a* stretched around these three rollers. The endless belt 4*a* is circularly driven in the direction indicated by an arrow mark in FIG. 1. Within the loop of the transfer belt 4*a*, transfer rollers 4Y, 4M, 4C, and 4BK, are positioned in a manner to press the belt 4*a* against the photosensitive drum 7 (7Y, 7M, 7C, and 7BK) from within the loop. As power is applied to charge each of these transfer rollers to polarity opposite to the polarity of the toner, the toner images on the photosensitive drums 7 are transferred in succession onto the top side of the intermediary transfer belt 4*a*.

As for the material for the intermediary transfer belt 4*a*, polyimide resin may be employed. Its selection does not need to be limited to polyimide resin; any of the following dielectric material may be used with good results: plastic such as polycarbonate resin, polyethylene-terephthalate resin, polyfluorovinylidine resin, polyethylene-naphthalate resin, polyether-ether-keton resin, polyether sulfonate resin, and polyurethane resin; and fluorinate or siliconized rubber.

After the transfer of the toner image, a certain amount of toner (hereinafter, "transfer residual toner") remains on the peripheral surface of the photosensitive drum 7. If the peripheral surface of the photosensitive drum 7 is subjected to a charging device, with the transfer residual remaining thereon, such a phenomenon occurs that the areas of the peripheral surface of the photosensitive drum 7 corresponding to the remaining toner image are charged to a potential level lower than the normal level, or that the image formed during the following rotation of the photosensitive drum 7 appears lighter or darker across the areas corresponding to the areas of the peripheral surface of the photosensitive drum 7 corresponding to the images formed in the preceding rotation of the photosensitive drum 7 (which hereinafter will be referred to as "ghost"). Even after passing through the area in which the magnetic brush is in contact with the peripheral surface of the photosensitive drum 7, the transfer residual toner remains virtually undisturbed, preserving most of the time the pattern of the preceding image. Therefore, it is necessary to take the transfer residual toner into the magnetic brush based charging device 8 to erase the trace of the preceding image, as the transfer residual toner is brought to the charging area by the rotation of the photosensitive drum 7. In this situation, the application of AC voltage to the magnetic brush based charging device 8 causes the electrical field between the photosensitive drum 7 and charging device 8 to oscillate to make it easier for the toner to be taken into the charging device 8. Also in this situation, it is more often than not that the transfer residual toner on the photosensitive drum 7 is a mixture of positively charged toner particles and negatively charged toner particles, because the negative polarity of some of toner particles is reversed by the electrical discharge which occurs during image transfer. However, in consideration of the ease with which the residual toner is taken into the magnetic brush based charging device 8, the polarity of the transfer residual toner is desired to be positive. In this embodiment, an electrically conductive brush 11 is placed in contact with the peripheral surface of the photosensitive drum 7, between the intermediary transferring apparatus 4 and magnetic brush based charging device 8, to apply to the transfer residual toner, bias, the polarity of which is opposite to that of the charge bias. As a result, the positively charged transfer residual toner particles pass the electrically conductive brush 11 untouched, whereas the negatively charged transfer residual toner particles are temporarily caught by the electrically conductive brush 11, and then are sent back onto the peripheral surface of the photosensitive drum 7 after having their charge removed. Consequently, the transfer residual toner is easily taken into the magnetic brush based charging device 8.

(Structure of Process Cartridge Frame)

The process cartridge B (BY, BM, BC, and BB) comprises a developing unit D and a charging unit C, which are connected to each other. The developing unit D comprises the electrophotographic photosensitive drum 7, developing means 10, and a developing means frame portion 12 in which the electrophotographic photosensitive drum 7 and developing means 10 are integrally placed, and the charging unit C comprises the charge roller 8*a*, regulating blade 8*c*, charge brush, and the like, and a charging means frame portion 13 in which the roller 8*a*, blade 8*c*, brush, and the like are integrally placed. The process cartridge B also comprises front and rear covers 16 and 17 (FIG. 4), as seen from the front side of the apparatus main assembly in terms of the longitudinal direction of the process cartridge B. The front and rear cover 17 connect the developing unit D and charging unit C and also fixes the positional relationship between the two units.

Figure 3:
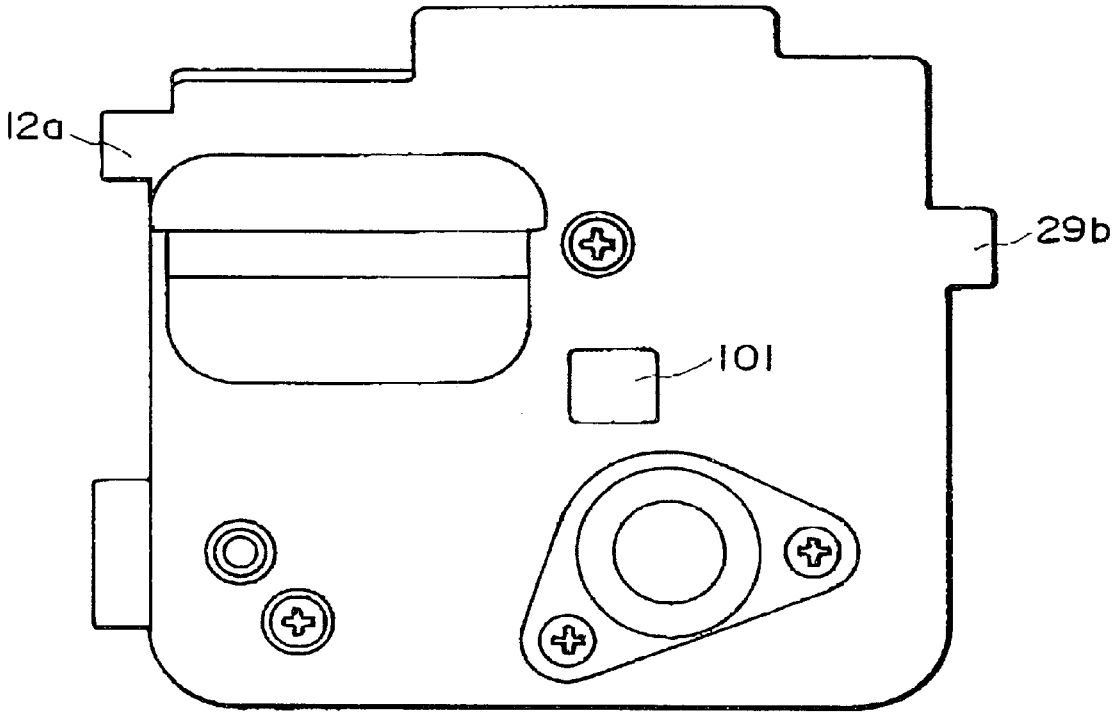
FIG. 3 is a front view of the process cartridge.
Figure 4:
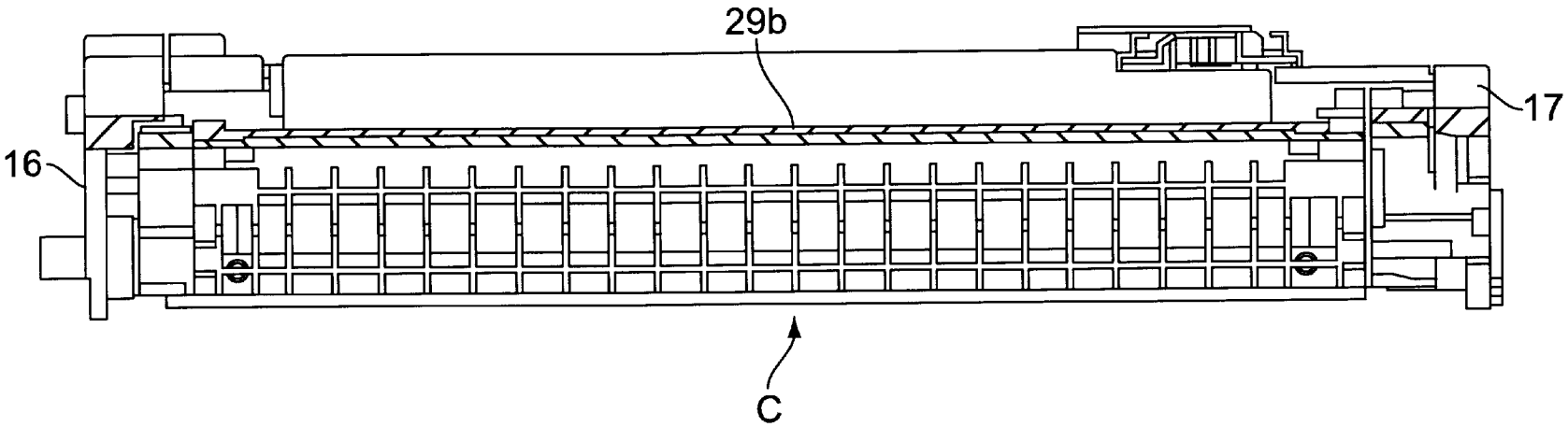
FIG. 4 is a right side view of the process cartridge.
Figure 5:
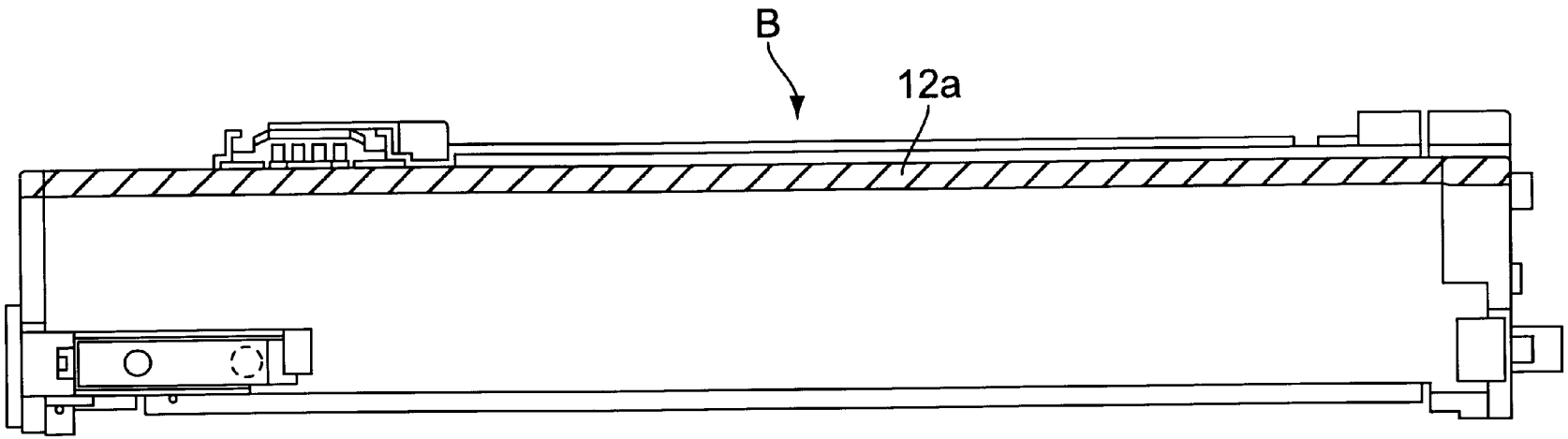
FIG. 5 is a left side view of the process cartridge
Figure 6:
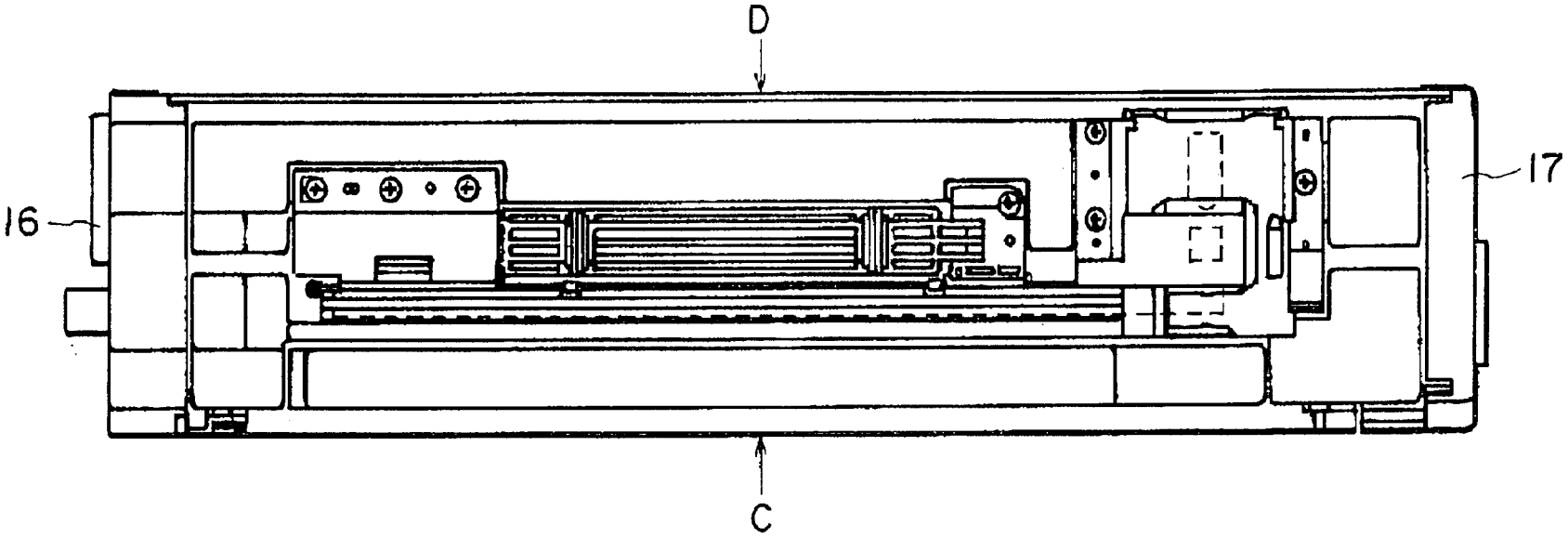
FIG. 6 is a top view of the process cartridge.
Figure 7:
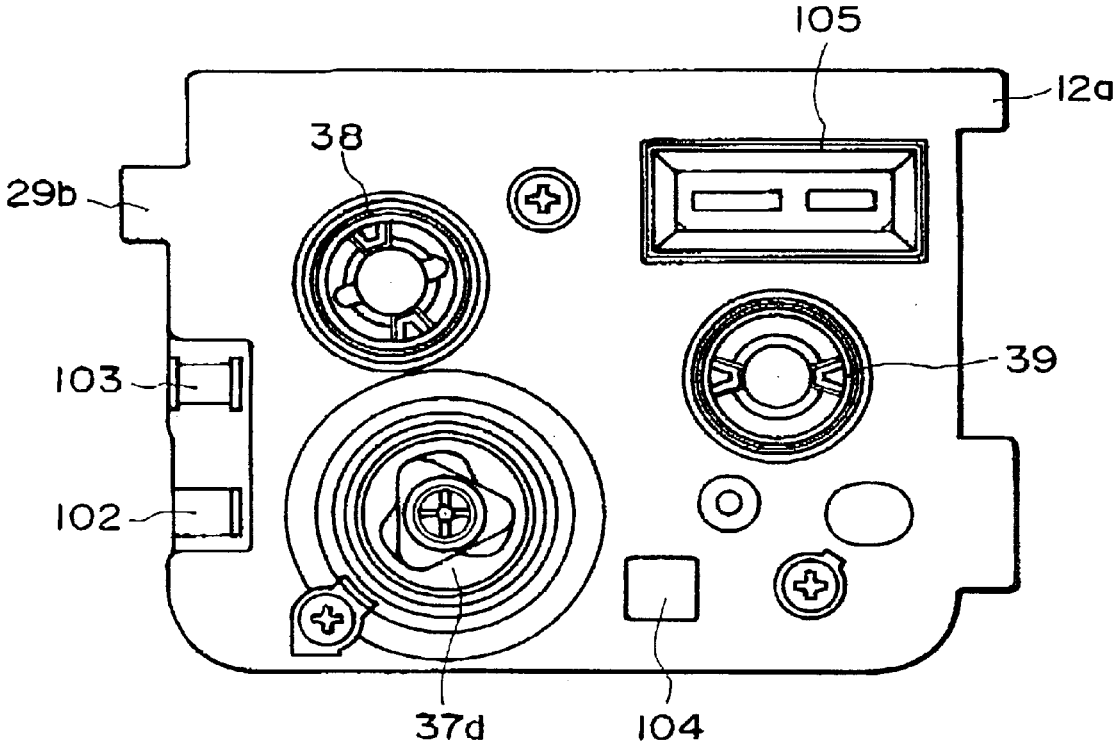
FIG. 7 is a rear view of the process cartridge.

FIGS. 3–7 are projected drawings of the process cartridge B (BY, BM, BC, and BB). FIG. 3 is a front view of the process cartridge B; FIG. 4, right side view; FIG. 5, left side view; FIG. 6, top view; and FIG. 7 is a rear view of the process cartridge B.

Referring to FIG. 2, the charging unit C integrally comprises the charge roller 8*a*, the regulating blade 8*c*, the electrically conductive brush 11, and the charging means frame 13. The charging means frame 13 constitutes a part of the external wall of the process cartridge B.

The charging unit C is supported by the developing means frame 12, being enabled to pivot about a pivotal axis SC illustrated in FIG. 2. More specifically, referring to FIG. 9, a gear unit 24 is fixed to rear end of the charging means frame 13, in terms of the longitudinal direction of the charging means frame portion 13, and the gear case 26 of the gear unit 24 is provided with a cylindrical shaft 26*a*, the axial line of which coincides with the aforementioned pivotal axis SC. Further, the other end of the charging unit C is covered with an end cover 23 with a cylindrical hole 23*a*, and the axial line of the cylindrical hole 23*a* coincides with the pivotal axis SC.

Also referring to FIG. 2, to the top of the developing means frame portion 12, a top plate 29 is solidly fixed in contact with the inward side of the guide portion 12, that is, the top portion of the side plate 12*g* of the developing means frame portion 12, and the edges of the front and rear side plates 12*h* and 12*i* (FIGS. 9 and 10) of the developing means frame portion 12.

Again referring to FIG. 2, the developing means frame portion 12 is provided with two spring seats 12*p* located at the longitudinal ends, one for one. Each spring seat 12*p* holds a compression coil spring 30 placed in the compressed state between the developing means frame portion 12 and cleaning means frame portion 13. Thus, the charging unit C remains under the pressure from the spring 30, which works in the direction to pivot the charging unit C about the pivotal axis SC in the clockwise direction in FIG. 2.

Figure 9:
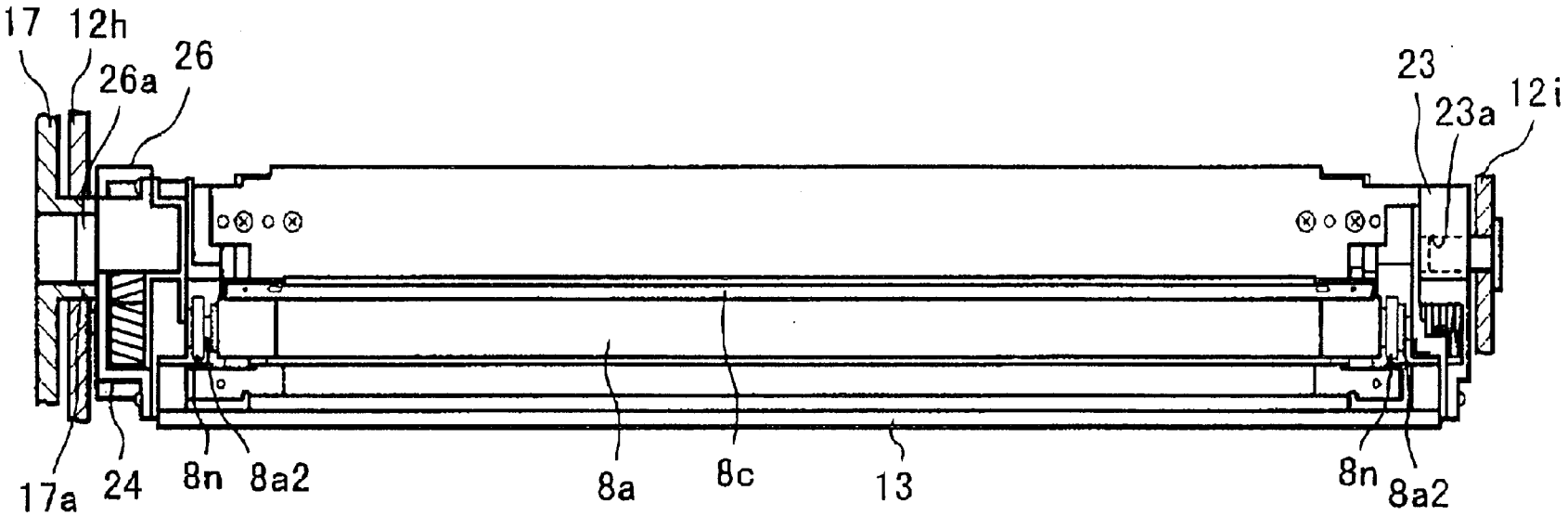
FIG. 9 is a front view of a charging unit.

Referring to FIG. 9, the charge roller 8*a* has journal portions 8*a*2, which are the longitudinal end portions of the charge roller 8*a*, and are smaller in diameter than the charge roller 8*a*, and the rotational axes of which coincide with that of the charge roller 8*a*. The journal portions 8*a*2 are fitted with a spacer ring 8*n* placed in contact with the peripheral surface of the journal portion 8*a*2. With the presence of the force from the aforementioned compression coil springs 30, the spacer rings 8*n* are kept directly pressed upon the photosensitive drum 7, outside the image formation area. With the provision of the above described structure, a gap is provided between the peripheral surfaces of the photosensitive drum 7 and charge roller 8*a*. Further, the moving directions of the peripheral surfaces of the charge roller 8*a* and photosensitive drum 7, in the area in which the peripheral surfaces of the charge roller 8*a* and photosensitive drum 7 squarely oppose each other, are made opposite to each other, and charge bias is applied to the charge roller 8*a* to capture the transfer residual toner while the transfer residual toner is passing through the area in which the peripheral surfaces of the charge roller 8*a* and photosensitive drum 7 squarely oppose each other.

In the description given above, the plane connecting the pivotal axis SC and the axial line of the charge roller 8*a* and the plane connecting the axial lines of the charge roller 8*a* and photosensitive drum 7 are approximately perpendicular to each other.

Figure 10:
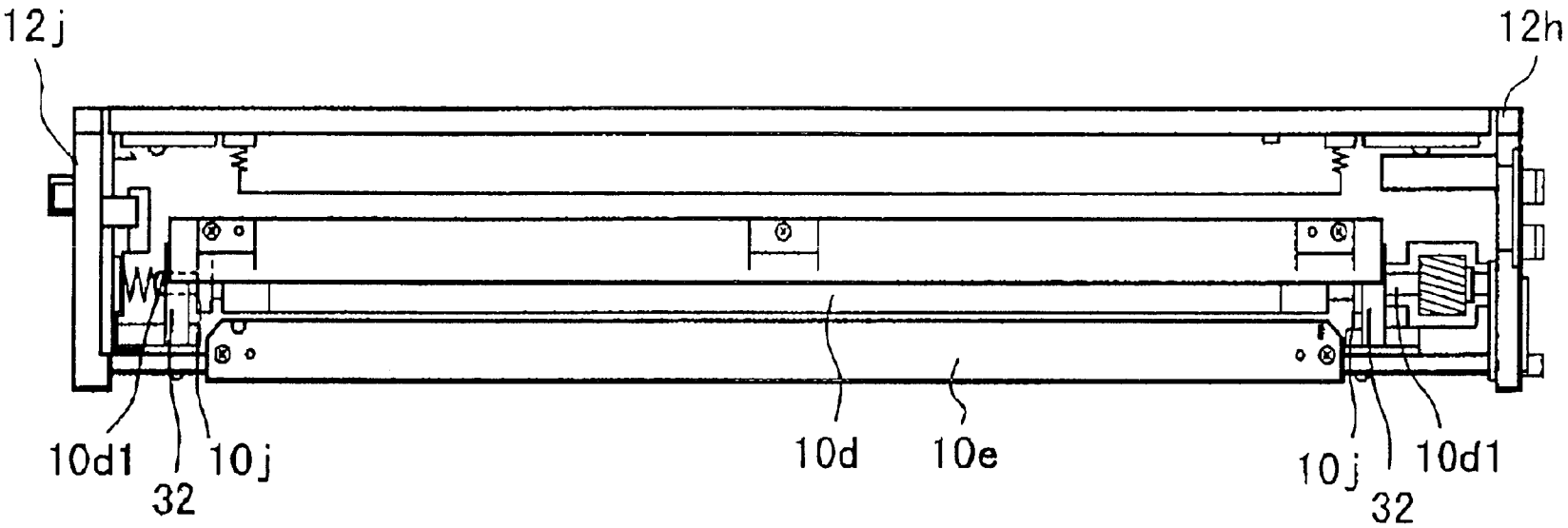
FIG. 10 is a side view of a developing unit.

Referring to FIG. 2, the development sleeve 10*d* is attached to the developing means frame portion 12, being allowed to pivot about a pivotal axis Slv as a pressure application fulcrum. Referring to FIG. 10, the development sleeve 10*d* has journal portions 10*d*1, which are the longitudinal end portions of the development sleeve 10*d*, and are smaller in diameter than the main portion of the development sleeve 10*d*. Each journal portion 10*d*1 is fitted with a spacer ring 10*j*, which is fitted around the peripheral surface of the journal portion 10*d*1, and is greater in radius by an amount equal to the amount of the development gap. On the outward side of the spacer ring 10*j*, each journal portion 10*d*1 is fitted in a pivotal arm 32.

Figure 11:
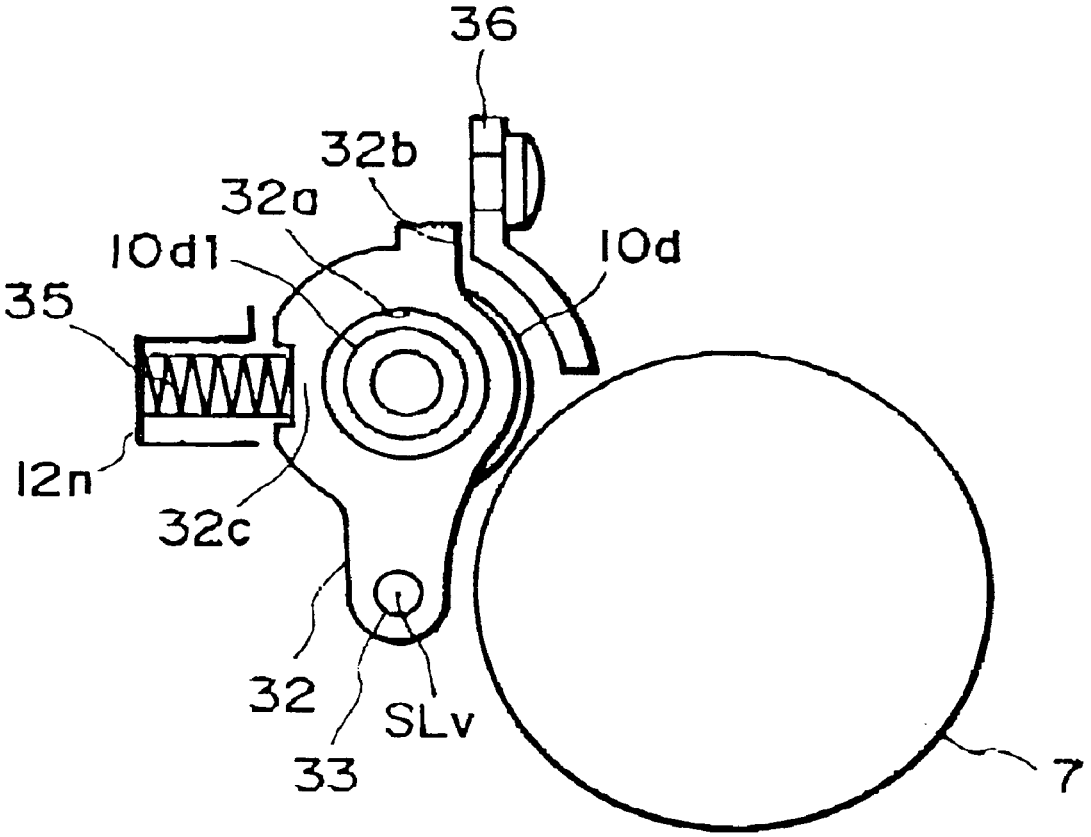
FIG. 11 is a front view of a development sleeve supporting portion.

FIG. 11 is a sectional view of one of the pivotal arms 32 and its adjacencies, at a plane perpendicular to the longitudinal direction of the development sleeve 10*d*. The pivotal arm 32 is pivotally supported at its base portion by a supporting shaft 33 press-fitted, in the longitudinal direction of the developing means frame portion 12, into the front side plate 12*h* (rear side plate 12*i*) of the developing means frame portion 12. The pivotal arm 32 is provided with a hole 32*a* with a bearing surface, which is positioned almost directly above the supporting shaft 33, and a stopper portion 32*b*, which is above the hole 32*a* with a bearing surface. The pivotal arm 32 is also provided with a spring seat portion 32*c*, the surface of which is perpendicular to the plane connecting the pressure application fulcrum Slv and the axial line of the hole 32*a* with a bearing surface.

In the hole 32*a* with a bearing surface, of the pivotal arm 32, the journal portion 10*d*1, or the longitudinal end portion of the development sleeve 10*d* is rotationally supported. Between the spring seat 32 and a spring seat 12*n* of the side plate 12*h* (12*i*) of the developing means frame portion 12, a compression coil spring 35 is placed in the compressed state. Therefore, the development sleeve 10*d* is kept pressed in the direction to pivot about the pressure application fulcrum Slv toward the photosensitive drum 7, causing the spacer ring 10*j* to be kept directly pressed upon the photosensitive drum 7, outside the image formation area on the longitudinal end portion. Consequently, a predetermined gap (0.2–1.0 mm) is kept between the development sleeve 10*d* and photosensitive drum 7.

The aforementioned stopper portion 32*b* comes into contact with a development sleeve cover 36 to prevent the pivotal arm 32 from rotating too far in the outward direction in FIG. 11, during the assembly or disassembly of the process cartridge B. Therefore, in the completed process cartridge B, the stopper 32*b* is not in contact with the development sleeve cover 36. Incidentally, the development sleeve cover 36 extends in the longitudinal direction between the pivotal arms 32, and is screwed to the development means frame portion 12.

(Structure for Mounting Process Cartridge into Image Forming Apparatus Main Assembly or Removing Process Cartridge Therefrom)

Referring to FIG. 2, the process cartridge B is provided with guide portions 12*a* (first cartridge guide portion) and 29*b* (second cartridge guide portion) in the form of a flange, which are located at the top left and top right corner of the process cartridge B as seen from the trailing side in terms of the process-cartridge-insertion direction. They horizontally project. These guide portions 21*a* and 29*b* exactly fit with the guide rails 201*a* and 201*b* as main assembly side guides of the apparatus main assembly 14 illustrated in FIG. 8, and are inserted into, or removed from, the apparatus main assembly 14 in the longitudinal direction. The guide portions 12*a* and 29*b* are square in cross section, contributing to increase the rigidity of the developing means frame portion 12 as the main portion of the cartridge frame, and the cleaning means frame portion 13, respectively. Also referring to FIG. 8, the guide rails 201*a* and 201*b* between the adjacent two process cartridges B are integrally formed parts of a single piece guiding member 201. The guide portion 12*a* is an integrally formed part of the developing means frame portion 12, whereas the guide portion 29*b* is an integrally formed part of the cleaning means frame portion 13.

The guide portions 12*a* and 29*b* are positioned so that when two or more process cartridges B are mounted in the apparatus main assembly 14, the guide portion 12*a* of one process cartridge B and the guide portion 29*b* of the adjacent process cartridge B do not occupy the same space; in this embodiment, the guide portions 12*a* and 29*b* are positioned so that the guide portion 29*b* of the adjacent process cartridge B fits below the guide portion 12*a* of the first process cartridge B.

With the provision of the above described structural arrangement, if an attempt is made to insert the process cartridge B into the apparatus main assembly 14, with the process cartridge B held in reverse, with respect to the front and rear sides of the process cartridge B in terms of its longitudinal direction, the guide portions 12*a* and 29*b* do not fit in the guide rails 201*a* and 201*b* on the apparatus main assembly 14 side because the vertical positions of the guide portion 12*a* and guide rail 201*a* are different from the vertical positions of the guide portion 29*b* and guide rail 201*b*. Therefore, a user will immediately realize the insertion mistake.

Figure 8:
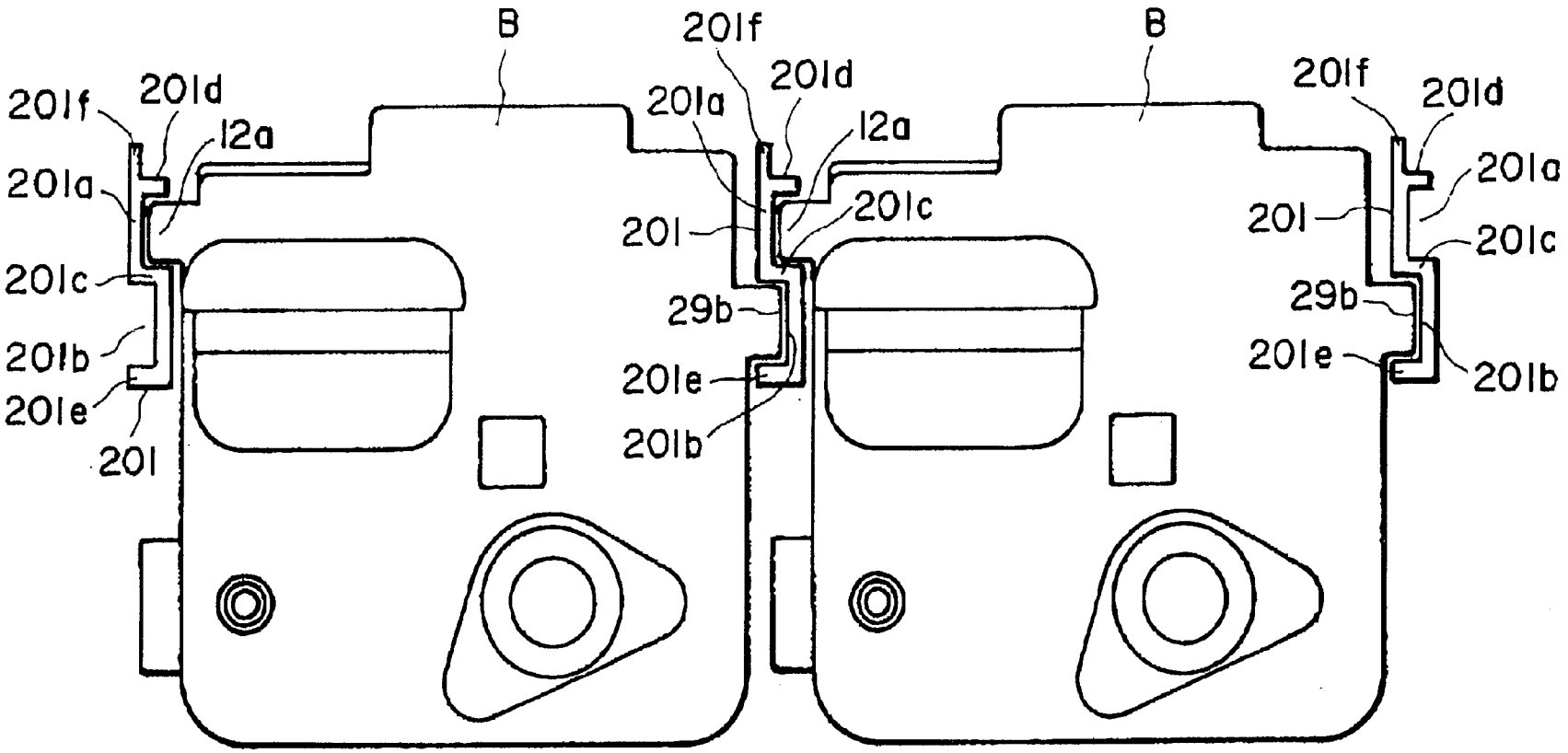
FIG. 8 is a front view of two process cartridges in the main assembly of an image forming apparatus.

Referring to FIG. 8, the guide rails 201*a* and 201*b* of each guide member 201 are in the form of a groove with a U-shaped cross section with a square bottom corners, and open in the opposing directions. They share a web 201*c*, and horizontally overlap each other; the guide rails 201*a* and 201*b* between the adjacent two process cartridges B overlap with each other in the horizontal direction. Therefore, the adjacent two process cartridges B can be placed closer to each other than in the conventional structure. More specifically, in terms of the cross sectional view, the guide member 201 has a Z-shaped main structure, two flanges 201*d* and 201*e* perpendicularly projecting in the opposite directions from the edges of the parallel portion of the Z-shaped main structure, one for one, and a portion 201*f* extending from the base portion of the flange 201*d* in the same direction as the parallel portions of the Z-shaped main structure. In other words, the guide member 201 is tall, and has three horizontal structural portions: web 201*c*, and flanges 201*d* and 201*e*. Therefore, it is large in modulus of section, horizontally and vertically; in other words, it is very strong. This means that the size of the guide member 201 could be reduced compared to the conventional guide member, provided that the loads to be borne by the guide member 201 and the conventional guide member are the same. Thus, according to the present invention, adjacent two process cartridges B can be mounted closer to each other, as shown in FIG. 8, compared to the conventional structural arrangement.

All the guide members 201 in the apparatus main assembly 14 are positioned at the same level, and are horizontally extended in the direction perpendicular to the running direction of the intermediary transfer belt 4*a*. In other words, all the guide members 201 are parallel to the surface of the intermediary transfer belt 4*a* comparable to the straight portions of the loop formed by the intermediary transfer belt 4*a*.

The above described guide member 201 is formed of plastic, metallic plate, or a combination of both materials.

The process cartridge B is provided with a number of contacts, which will be placed in contact with the corresponding contacts on the main assembly side connected to an unillustrated high voltage power source with which the apparatus main assembly 14 is provided, as the process cartridge B is mounted into the apparatus main assembly 14.

Referring to FIG. 3, the process cartridge B is provided with a drum grounding contact 101, which is on the trailing side in terms of the process cartridge insertion direction, and is connected to the photosensitive drum 7. Next, referring to FIG. 7, the process cartridge B is also provided with an electrically conductive brush contact 102 connected to the electrically conductive brush 11, a charge bias contact 103 connected to the charge roller 8*a*, and a development bias contact 104 connected to the development sleeve 10*d*, which are located on the leading side in terms of the process cartridge insertion direction. These contacts 102, 103, and 104 come into contact with the corresponding contacts, on the apparatus main assembly side, connected to a high voltage power source on the apparatus main assembly side, as the process cartridge B is mounted into the apparatus main assembly 14. The process cartridge B is also provided with a connector 105 with an IC, which is on the leading side in terms of the process cartridge insertion direction, that is, the same side as the side on which the electrically conductive brush contact 102, charge bias contact 103, and development bias contact 104, are located. As the process cartridge B is mounted into the apparatus main assembly 14, the connector 105 with an IC is connected with an unillustrated connector on the apparatus main assembly side, and the controlling apparatus on the apparatus main assembly side writes the usage history of the process cartridge B into the connector 105 with an IC, or reads it from the connector 105 with an IC, to use for control.

The process cartridge B is provided with three driving force receiving portions in the form of a coupler which rotate around corresponding shafts extending in the longitudinal direction of the process cartridge B. They are on the leading end surface in terms of the process cartridge insertion direction. As the process cartridge B is mounted into the apparatus main assembly 14, the three driving force receiving portions are connected with the corresponding driving members on the apparatus main assembly 14.

Referring to FIG. 7, the leading end surface of the process cartridge B in terms of the process cartridge insertion direction is provided with a drum coupling projection 37*d* as a drum driving force receiving portion for receiving the driving force for rotating the photosensitive drum 7, a charging portion coupling 38 for receiving the driving force for rotating the charge roller 8*a*, and a developing portion coupling 39 for receiving the driving force for rotating the development sleeve 10*d*. Those couplings are exposed from the process cartridge B.

To sum up the descriptions regarding the process cartridge mounting guides, the process cartridge B removably mountable in the main assembly of an electrophotographic image forming apparatus comprises a cartridge frame (developing means frame portion 12 and charging means frame portion 13); the electrophotographic photosensitive member 7; a single or plural processing means which act on the photosensitive member 7 (at least one processing means among the developing means 10, charging member 8*a*, and cleaning member); the first cartridge guide portion 12*a*, which is guided by the guide (guide rail 201*a*) provided on the image forming apparatus main assembly side, and is located on one of the end surfaces of the cartridge frame (developing means frame portion 12) in terms of the process cartridge insertion or removal direction; and the second cartridge guide portion 29*b*, which is guided by the guide (guide rail 210*b*) provided on the apparatus main assembly side, and is located on the other end surface of the cartridge frame (charging means frame portion 13) in terms of the process cartridge-insertion or removal direction, wherein the second cartridge guide portion 29*b* is positioned so that after the process cartridge B is properly positioned in the apparatus main assembly, the second cartridge guide portion 29*b* is different in vertical position from the first cartridge guide portion 12*a*.

When two or more process cartridges B (BY, BM, BC, and BB) are mounted side by side in the apparatus main assembly, they are mounted in such a manner that the first cartridge guide portion 12*a* of one of the adjacent two process cartridges B is placed next to the second cartridge guide portion 29*b* of the other process cartridge.

The first and second cartridge guide portions 12*a* and 29*b* project from the cartridge frame in such a manner that when two or more process cartridges B (BY, BM, BC, and BB) are mounted side by side in the apparatus main assembly, the first cartridge guide portion 12*a* of one of the adjacent two process cartridges B and the second cartridge guide portion 29*b* of the other process cartridge B overlap with each other in terms of the vertical direction.

The first and second cartridge guide portions 12*a* and 29*b* extend in the direction parallel to the direction in which the process cartridge B is mounted into, or removed from, the apparatus main assembly.

The process cartridge B is provided with a drum driving force receiving portion (projection 37*d*), which is for receiving the driving force for rotating the photosensitive drum 7, from the apparatus main assembly 14, and is located on the leading side in terms of the direction in which the process cartridge B is mounted into the apparatus main assembly 14.

(Means for Supporting Photosensitive Drum and Means for Driving Photosensitive Drum)

Figure 12:
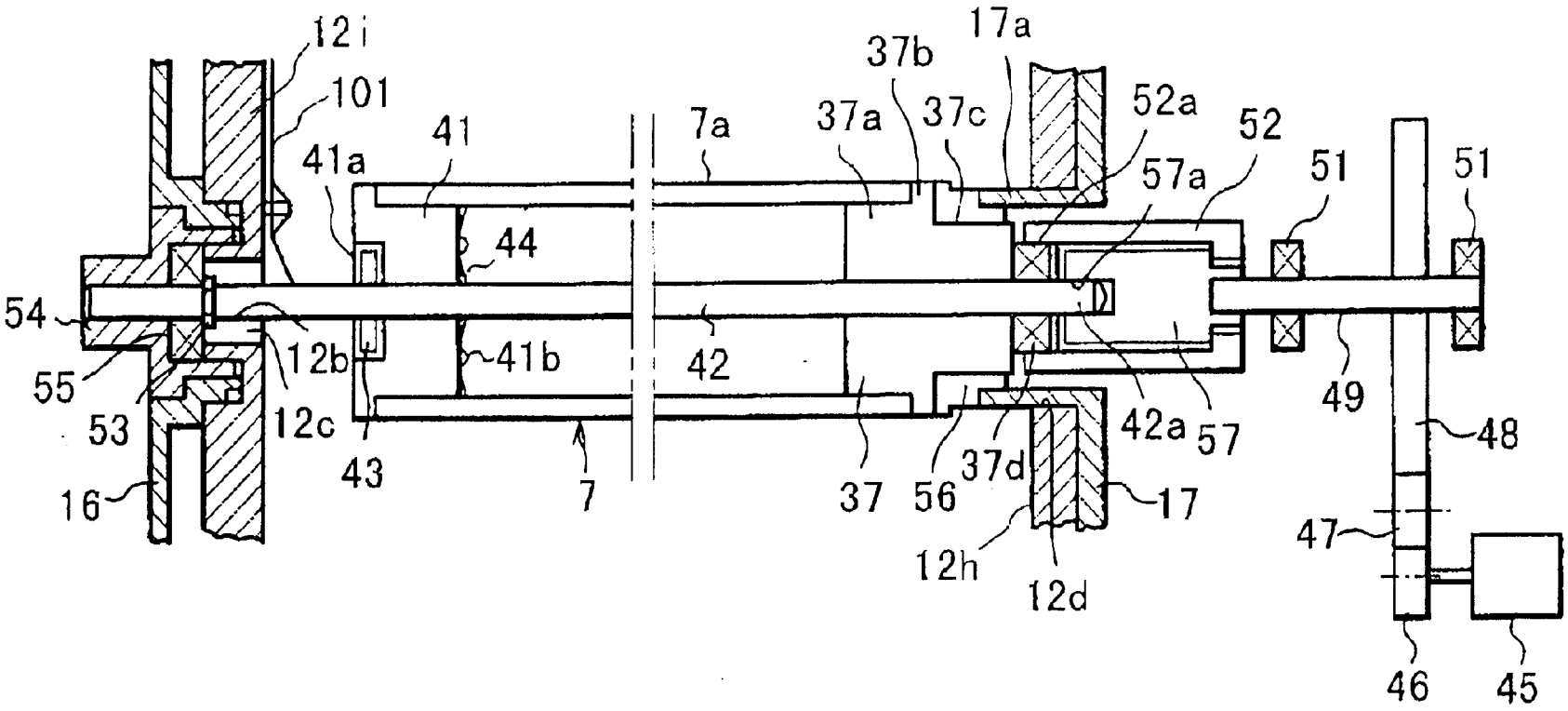
FIG. 12 is a vertical sectional view of an electrophotographic photosensitive drum supporting portion and an electrophotographic photosensitive drum driving apparatus.

The drum coupling projection 37*d* is located at the end of a drum flange 37 solidly fixed to one of the longitudinal ends of the photosensitive drum 7. FIG. 12 shows a method for supporting the photosensitive drum 7 as well as a method for driving the photosensitive drum 7. The photosensitive drum 7 comprises a hollow aluminum cylinder 7*a*, a layer of photosensitive material coated on the peripheral surface of the cylinder 7*a*, a drum flange 37 firmly anchored, by insertion, to the longitudinal end of the cylinder 7*a*, on the side from which the photosensitive drum 7 is driven (hereinafter, "driven side"), and a drum flange 41 firmly anchored, by insertion, to the longitudinal end of the cylinder 7*a*, on the side from which the photosensitive drum 7 is not driven (hereinafter, "non-driven side"). One end of a drum shaft 42 put through the center holes of the drum flanges 37 and 41 extends through a through hole 12*b* in the end wall 12*i* of the developing means frame portion 12 at one of the longitudinal ends of the process cartridge B. A pin 4*e* press-fitted through the drum shaft 42 in the diameter direction is exactly fitted in a groove 41*a* extending in the radial direction of the drum flange 41 on the non-driven side, from the center hole of the drum flange 41. An electrically conductive spring 44 for electrically connecting the drum shaft 42 and cylinder 7*a* is fixed to the inwardly facing surface of the drum flange 41 on the non-driven side. As for the method for fixing this electrically conductive spring 44, the dowel-like projections 41*b* of the drum flange 41 are put through the holes of the spring 44, and the dowel-like projections are melted and solidified. One end of the electrically conductive spring 44 is kept in contact with the internal surface of the cylinder 7*a* by its own resiliency, and the other end of the spring 44 is kept in contact with the drum shaft 42 also by its own resiliency.

One end of the drum grounding contact 101 attached to the end plate of the developing means frame portion 12 in terms of the longitudinal direction of the process cartridge B remains in contact with the drum shaft 42 due to its own resiliency. This drum grounding contact 101 is fixed to the developing means frame portion 12, on the inward side, and extends outward through the developing means frame portion 12. This portion of the drum grounding contact 101 outside the developing means frame portion 12 serves as an external contact.

The wall of the through hole 12*b* of the aforementioned end wall 12*i* is provided with a set of slits which oppose each other in the radial direction, with respect to the axial line of the through hole 12*b*, so that the pin 43 can be put through the end wall 12*i* in the longitudinal direction of the process cartridge B during the assembly of the process cartridge B.

The driven side drum flange 37 has: an anchoring portion 37*a* fitted in the cylinder 7*a*; a collar portion 37*b* which contacts the end of the cylinder 7*a*; a journal portion 37*c* which is smaller in diameter than the collar portion 37*b*; and the aforementioned coupling projection 37*d* which projects from the center of the journal portion 37*c* in the axial direction of the drum flange 37, which are positioned in the listed order from the inward side in terms of the longitudinal direction of the process cartridge B. The driven side drum flange 37 is a single piece component formed of plastic.

The journal portion 37*c* is rotationally fitted in the shaft supporting portion 17*a*, that is, an integrally formed part of the end cover 17 inserted in a hole 12*d* of the end wall 12*h* of the developing means frame portion 12, with the interposition of a collar 56 between the journal portion 37*c* and shaft supporting portion 17*a*.

Figure 13:
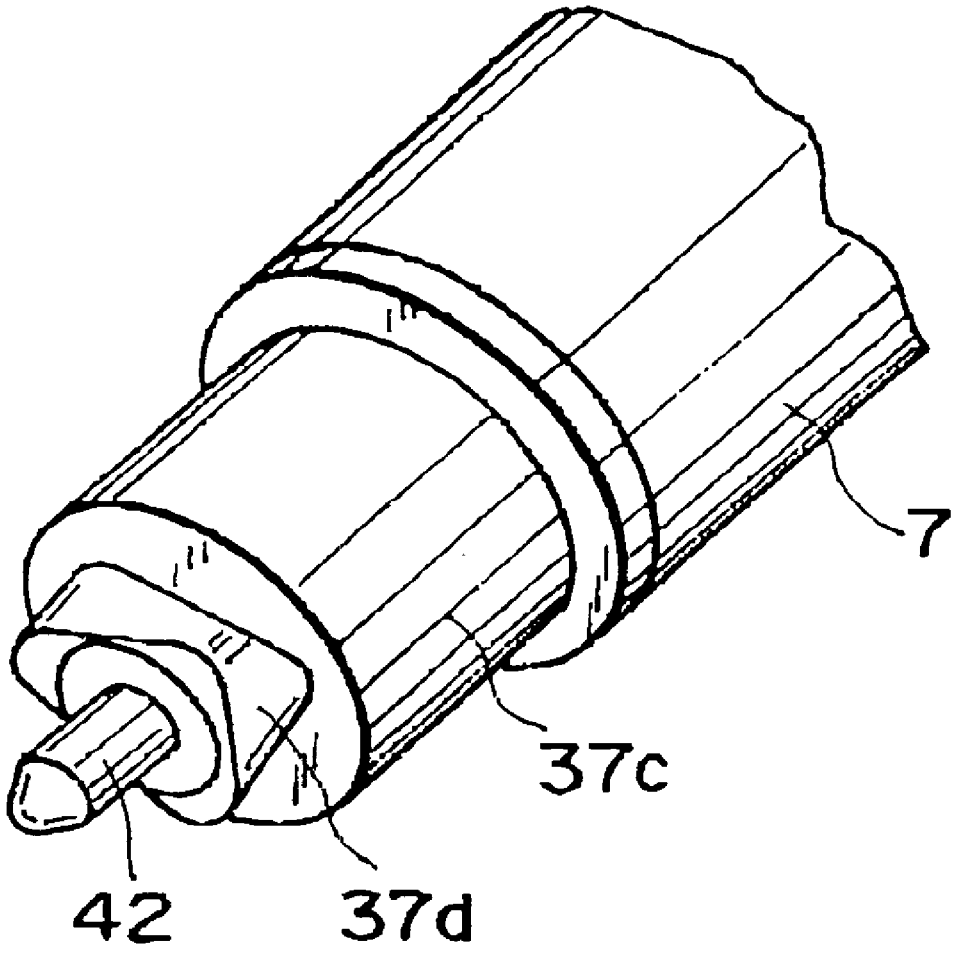
FIG. 13 is a perspective view of the drum flange on the side from which a drum is driven.

Referring to FIG. 13, the coupling projection 37*d* is in the form of a twisted equilateral triangular pillar, the axial line of which coincides with that of the drum shaft 42. The circumcircle of the coupling projection 37*d* in the form of this triangular pillar is smaller in diameter than that of the journal portion 37*c*.

The driving apparatus with which the apparatus main assembly 14 is provided comprises: a motor 45 firmly fixed to the apparatus main assembly 14; a pinion gear 46 fixed to the motor shaft of the motor 45; an intermediary gear 47 which is rotationally supported and is meshed with the pinion gear 46 and a large gear 48; the large gear 48; a large gear shaft 49 which is fixed to the large gear 48, and the inward end of which is firmly fitted in the aligning portion 57; a bearing 51; and a coupling shaft 52 with a coupling hole.

The bearing 51 supports the large gear shaft 49 in a manner to prevent the large gear 49 shaft from moving in the axial direction of the shaft 49. A coupling hole 52*a* is a hole in the form of a twisted equilateral triangular pillar, which engages with, or disengages from, the coupling projection 37*d* in the shaft direction. With the coupling projection 37*d* being in the coupling hole 52*a*, the contact between the lateral edges of the coupling projection 37*d* in the form of a twisted equilateral triangular pillar and the corresponding lateral surfaces of the coupling hole 52*a* in the form of a twisted equilateral triangular pillar aligns the rotational axes of the coupling projection 37*d* and coupling hole 52*a*. A small amount of tolerance in the radial direction is provided between the cylindrical peripheral surface of the aligning portion 57 and the cylindrical internal surface of the coupling shaft 52 with the coupling hole 52*a*, to afford them a small amount of deviation in the radial direction from the common rotational axis in order to prevent them from interfering with each other as they rotate. The coupling shaft 52 with the coupling hole 52*a* is kept as close as possible to the process cartridge B while being supported so as to be allowed to retract against the force from an unillustrated resilient member (detailed description will not be given here).

The portion which supports the non-driven side of the drum shaft 42 is structured to prevent the drum shaft 42 from shifting toward the non-driven side. More specifically, as shown in the drawing, the drum shaft 42 is provided with a shaft stopper ring 53, which is fitted around the drum shaft 42. To the end wall 12*i* of the developing means frame portion 12, the aforementioned front cover 16 is fixed, and to this front cover 16, a bearing case 54, in which a bearing 55 is placed, is fixed. The bearing 55 is fitted around the drum shaft 42, and one of its lateral surfaces is placed in contact with the shaft stopper ring 53 and the other surface is placed in contact with the bottom surface of the bearing case 54, thereby preventing the drum shaft 42 from shifting toward the non-driven side. On the other hand, the movement of the photosensitive drum 7 toward the driven side is regulated by the interposition of the collar 56 in which the journal portion 37*c* of the drum flange 37 is fitted. In order to afford the photosensitive drum 7 a limited amount of shifting in its axial direction, the distance between the shaft supporting portion 17*a* of the end cover 17 and bearing 55 is rendered greater than both the distance between the outwardly facing surface of the shaft stopper ring 53 and the shaft supporting portion 17*a*, and the distance between the mutually facing surfaces of the collar 56 and bearing 55.

Since the driving apparatus is structured as described above, as the process cartridge B is mounted into the image forming apparatus main assembly 14, the position of the cartridge frame (developing means frame portion 12, front cover 16, and rear cover 17) relative to the apparatus main assembly 14 in terms of the longitudinal direction of the process cartridge B, becomes fixed. Further, the end portion 42*a* of the drum shaft 42 fits into the center hole 57*a* of the aligning portion 57, and the coupling projection 37*d* enters the coupling hole 52*a* of the coupling shaft 52. Then, as the motor 45 rotates, the pinion gear 46, intermediary gear 47, and large gear 48 rotate. As a result, the coupling shaft 52 with the coupling hole 52*a* is rotated by the driving force transmitted through the gear shaft 49 and aligning portion 57. This rotation of the coupling shaft 52 causes such an effect that the coupling projection 37*d* and coupling hole 52*a* in the form of a twisted equilateral triangular pillar engage with each other in a manner of male and female screws, thereby causing the drum flange 37 and coupling shaft 52 to pull each other. As a result, the end of the coupling projection 37*d* comes into contact with the bottom surface of the coupling hole 52*a*; in other words, the position of the photosensitive drum 7 in terms of its axial direction becomes fixed relative to the coupling shaft 52, the position of which has been fixed.

Incidentally, when the coupling projection 37*d* does not enter the coupling hole 52*a* as the process cartridge B is mounted into the apparatus main assembly 14, the end surface of the coupling projection 37*d* comes into contact with the edge portion of the coupling hole 52*a* of the coupling shaft 52, and pushes back the coupling shaft 52 against the force generated by the unillustrated resilient member in the direction to push the coupling shaft 52 toward the process cartridge B. In other words, after the completion of the mounting of the process cartridge B into the apparatus main assembly 14, the coupling shaft 52 is under the pressure directed toward the process cartridge B. Therefore, as soon as the coupling projection 37*d* and coupling hole 52*a* align with each other in terms of rotational phase after the coupling shaft 52 begins to be rotated, the coupling projection 37*d* instantly enters the coupling hole 52*a*. Regarding the aforementioned fixation of the position of the photosensitive drum 7, instead of placing the end surface of the coupling projection 37*d* in contact with the bottom surface of the coupling hole 52*a* as described above, the position of the collar 57*b* of the drum flange 37 may be fixed relative to the shaft supporting portion 17*a* through the collar 56 by the force generated by the coupling projection 37*d* and coupling hole 52*a* in the direction to cause the two coupling portions 37*d* and 52*a* to pull each other.

The application of this embodiment to a multicolor image forming apparatus makes it possible to reduce the size of interval between the adjacent two process cartridges, therefore enabling the reduction of apparatus size. In addition, it prevents a process cartridge from being inserted in reverse, with respect to the front and rear sides of the process cartridge in terms of its longitudinal direction. Thus, the present invention is also applicable to a monochromatic image forming apparatus to prevent such an erroneous mounting of a process cartridge that a process cartridge is inserted in reverse in terms of the process cartridge insertion direction.

This embodiment was described with reference to a multicolor image forming apparatus provided with an intermediary transferring member. However, the present invention is also effectively applicable to a multicolor image forming apparatus in which multiple toner images are transferred in succession and in layers onto recording medium being conveyed by a conveying means, from a plurality of process cartridges mounted in parallel, instead of the provision of an intermediary transferring member.

The embodiments of the present invention is summarized as follows:

1. A process cartridge (B) detachably mountable to a main assembly (14) of an electrophotographic image forming apparatus, comprising:
   a cartridge frame (developing means frame 12, charging means frame 13);
   an electrophotographic photosensitive member (7);
   process means (developing means 10, charging member 8*a* or cleaning member) actable on the photosensitive member (7);
   a first cartridge guiding portion (12*a*) for being guided by a main assembly guide (guide rail 201*a*) provided in the main assembly of the apparatus when the process cartridge (B) is mounted to the main assembly of the apparatus, the first cartridge guiding portion (12*a*) being provided at one end, with respect to a mounting direction in which the process cartridge (B) is mounted to the main assembly of apparatus, of the cartridge frame (developing means frame 12); and
   a second cartridge guiding portion (29*b*) for being guided by the main assembly guide (guide rail 201*a*) provided in the main assembly of the apparatus when said process cartridge (B) is mounted to the main assembly of apparatus, the second cartridge guiding portion (29*b*) being provided at the other end, with respect to the mounting direction of the cartridge frame (charging means frame 13), wherein when the process cartridge (B) is mounted to the main assembly of the apparatus, the first and second cartridge guiding portion (29*b*) s are at different heights.
2. A process cartridge (B) according to Item 1, wherein a plurality of such process cartridges (BY, BM, BC, BB) are juxtaposed with each other with the first cartridge guiding member of one of the juxtaposed process cartridge (B)s and the second cartridge guiding member of the other of the juxtaposed process cartridge (B)s.
3. A process cartridge (B) according to Item 2, wherein the first cartridge guiding portion (12*a*) and the second cartridge guiding portion (29*b*) are overlaid in a substantially vertical direction and are projected out of the cartridge frame (developing means frame 12, charging means frame 13).
4. A process cartridge (B) according to Item 1, 2 or 3, wherein the first cartridge guiding portion (12*a*) and the second cartridge guiding portion (29*b*) are projected out of the cartridge frame (developing means frame 12, charging means frame 13) in the mounting direction.
5. A process cartridge (B) according to Item 4, further comprising a driving force receiving portion (projection 37*d*) for receiving from the main assembly of the apparatus a driving force for rotating the photosensitive member (7), the driving force receiving portion being provided at a leading end portion, with respect to the mounting direction.

According to the present invention, it is possible to prevent such an erroneous mounting of a process cartridge that a process cartridge is mounted in reverse, in terms of the process cartridge insertion direction, into the main assembly of an image forming apparatus.

Further, the present invention makes it possible to reduce the size of a multicolor image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive member;

process means actable on said photosensitive member a first cartridge guiding portion for being guided by a main assembly guide provided in the main assembly of the apparatus when said process cartridge is mounted to the main assembly of the apparatus, said first cartridge guiding portion being provided at one end, with respect to a mounting direction in which said process cartridge is mounted to the main assembly of apparatus, of said cartridge frame; and a second cartridge guiding portion for being guided by the main assembly guide provided in the main assembly of the apparatus when said process cartridge is mounted to the main assembly of apparatus, said second cartridge guiding portion being provided at the other end, with respect to the mounting direction, of said cartridge frame, wherein said first cartridge guiding portion and said second cartridge guiding portion project in directions substantially perpendicular to a longitudinal direction of said process cartridge, and wherein when said process cartridge is mounted to the main assembly of the apparatus, said first and second cartridge guiding portions are at different heights.

2. A process cartridge according to claim 1, wherein when a plurality of such process cartridges are mounted to the main assembly of said apparatus, said process cartridges are juxtaposed with each other with said first cartridge guiding portion of one of the juxtaposed process cartridges and said second cartridge guiding portion of the other of the juxtaposed process cartridges being adjacent to each other.

3. A process cartridge according to claim 2, wherein when said process cartridge is mounted to the main assembly of apparatus, said first cartridge guiding portion and said second cartridge guiding portion are overlaid in a substantially vertical direction and project out of said cartridge frame.

4. A process cartridge according to claim 1, 2 or 3, wherein said first cartridge guiding portion and said second cartridge guiding portion project outwardly from said cartridge frame and extend in the mounting direction.

5. A process cartridge according to claim 4, further comprising a driving force receiving portion for receiving from the main assembly of the apparatus a driving force for rotating said photosensitive member, said driving force receiving portion being provided at a leading end portion, with respect to the mounting direction.

6. A process cartridge according to claim 1, wherein said process means includes at least one of developing means for developing an electrostatic latent image formed on said photosensitive member, charging means for electrically charging said photosensitive member and cleaning means for removing a developer remaining on said developer remaining on said photosensitive member.

7. A process cartridge detachably mountable to a main assembly of an electrophotographic image forming apparatus, comprising:

a cartridge frame:

an electrophotographic photosensitive member;

a developing roller for developing an electrostatic latent image formed on said photosensitive member;

a charging member for electrically charging said photosensitive member;

a first cartridge guiding portion for being guided by a main assembly guide provided in the main assembly of the apparatus when said process cartridge is mounted to the main assembly of the apparatus, said first cartridge guiding portion being provided at one end, with respect to a mounting direction in which said process cartridge is mounted to the main assembly of apparatus, of said cartridge frame second cartridge guiding portion for being guided by a main assembly guide provided in the main assembly of the apparatus when said process cartridge is mounted to the main assembly of apparatus, said second cartridge guiding portion being provided at the other end, with respect to the mounting direction, of said cartridge frame, wherein said first cartridge guiding portion and said second cartridge guiding portion project in directions substantially perpendicular to a longitudinal direction of said process cartridge, and wherein when said process cartridge is mounted to the main assembly of the apparatus, said first and second cartridge guiding portions are at different heights; and a driving force receiving portion for receiving from the main assembly of the apparatus a driving force for rotating said photosensitive member, said driving force receiving portion being provided at a leading end portion, with respect to the mounting direction;

wherein when a plurality of such process cartridges are mounted to the main assembly of said apparatus, said process cartridges are juxtaposed with each other with said first cartridge guiding member of one of the juxtaposed process cartridges and said second cartridge guiding member of the other of the juxtaposed process cartridges being adjacent to each other, and wherein said first cartridge guiding portion and said second cartridge guiding portion project outwardly from said cartridge frame and extend in the mounting direction.

8. A process cartridge according to claim 7, wherein when said process cartridge is mounted to the main assembly of apparatus, said first cartridge guiding portion and said second cartridge guiding portion are overlaid in a substantially vertical direction and project out of said cartridge frame.

9. A process cartridge according to claim 1 or 7, wherein said first cartridge guiding portion and said second cartridge guiding portion extend from a trailing side of said cartridge frame toward a leading side thereof with respect to the mounting direction.

10. A process cartridge according to claim 1, wherein said first cartridge guiding portion and a developing roller as said process means are disposed on the same side of said photosensitive member; said second cartridge guiding portion and a charging member as said process means are disposed on same side of said photosensitive member; and said first cartridge guiding portion and said second guiding portion extend in a longitudinal direction of said photosensitive member in the form of a drum.

11. A process cartridge according to claim 7, wherein said first cartridge guiding portion and a developing roller as said process means are disposed on the same side of said photosensitive member; said second cartridge guiding portion and a charging member as said process means are disposed on same side of said photosensitive member; and said first cartridge guiding portion and said second guiding portion extend in a longitudinal direction of said photosensitive member in the form of a drum.

12. An electrophotographic image forming apparatus for forming an image on a recording material, to which a process cartridge is detachably mountable, said apparatus comprising:

(a) a main assembly guide;

(b) mounting means for detachably mounting a process cartridge, said process cartridge including:

a cartridge frame;

an electrophotographic photosensitive member;

process means actable on said photosensitive member;

a first cartridge guiding portion for being guided by the main assembly guide when said process cartridge is mounted to the main assembly of the apparatus, said first cartridge guiding portion being provided at one end, with respect to a mounting direction in which said process cartridge is mounted to the main assembly of apparatus, of said cartridge frame; and a second cartridge guiding portion for being guided by the main assembly guide when said process cartridge is mounted to the main assembly of apparatus, said second cartridge guiding portion being provided at the other end, with respect to the mounting direction, of said cartridge frame, wherein said first cartridge guiding portion and said second cartridge guiding portion project in directions substantially perpendicular to a longitudinal direction of said process cartridge, and wherein when said process cartridge is mounted to the main assembly of the apparatus, said first and second cartridge guiding portions are at different heights.

13. An electrophotographic image forming apparatus for forming an image on a recording material, to which a process cartridge is detachably mountable, said apparatus comprising:

(i) a main assembly side guide;

(ii) mounting means for detachably mounting a process cartridge, said process cartridge including:

a cartridge frame;

an electrophotographic photosensitive member:

a developing roller for developing an electrostatic latent image formed on said photosensitive member;

a charge member for electrically charging said photosensitive member;

a first cartridge guiding portion for being guided by the main assembly guide when said process cartridge is mounted to the main assembly of the apparatus, said first cartridge guiding portion being provided at one end, with respect to a mounting direction in which said process cartridge is mounted to the main assembly of apparatus, of said cartridge frame;

a second cartridge guiding portion for being guided by the main assembly guide when said process cartridge is mounted to the main assembly of apparatus, said second cartridge guiding portion being provided at the other end, with respect to the mounting direction, of said cartridge frame, wherein said first cartridge guiding portion and said second cartridge potion project in directions substantially perpendicular to a longitudinal direction of said process cartridge, and wherein when said process cartridge is mounted to the main assembly of the apparatus, said first and second cartridge guiding portions are at different heights; and a driving force receiving portion for receiving from the main assembly of the apparatus a driving force for rotating said photosensitive member, said driving force receiving portion being provided at a leading end portion, with respect to the mounting direction, wherein when a plurality of such process cartridges are mounted to the main assembly of said apparatus, said process cartridges are juxtaposed with each other with said first cartridge guiding member of one of the juxtaposed process cartridges and said second cartridge guiding member of the other of the juxtaposed process cartridges being adjacent to each other, and wherein said first cartridge guiding portion and said second cartridge guiding portion project outwardly from said cartridge frame and extend in the mounting direction.

14. A process cartridge detachably mountable to a main assembly of an electrophotographic image forming apparatus, comprising:

a cartridge frame:

an electrophotographic photosensitive drum;

a developing roller for developing an electrostatic latent image formed on said photosensitive drum;

a charging member for electrically charging said photosensitive drum;

a first cartridge guiding portion for being guided by a main assembly guide provided in the main assembly of the apparatus when said process cartridge is mounted to the main assembly of the apparatus, said first cartridge guiding portion being provided at one end, with respect to a mounting direction in which said process cartridge is mounted to the main assembly of apparatus, of said cartridge frame a second cartridge guiding portion for being guided by a main assembly guide provided in the main assembly of the apparatus when said process cartridge is mounted to the main assembly of apparatus, said second cartridge guiding portion being provided at the other end, with respect to the mounting direction, of said cartridge frame, wherein said first cartridge guiding portion and said second cartridge guiding portion project in directions substantially perpendicular to a longitudinal direction of said process cartridge, and wherein when said process cartridge is mounted to the main assembly of the apparatus, said first and second cartridge guiding portions are at different heights; and a driving force receiving portion for receiving from the main assembly of the apparatus a driving force for rotating said photosensitive member, said driving force receiving portion being provided at a leading end portion, with respect to the mounting direction;

wherein when a plurality of such process cartridges are mounted to the main assembly of said apparatus, said process cartridges are juxtaposed with each other with said first cartridge guiding member of one of the juxtaposed process cartridges and said second cartridge guiding member of the other of the juxtaposed process cartridges being adjacent to each other, wherein said first cartridge guiding portion and said second cartridge guiding portion project outwardly from said cartridge frame and extend in the mounting direction, wherein said first cartridge guiding portion and said second cartridge guiding portion extend from a trailing side of said cartridge frame toward a leading side thereof with respect to the mounting direction, and wherein said first cartridge guiding portion and a developing roller as said process means are disposed on the same side of said photosensitive drum; said second cartridge guiding portion and a charging member as said process means are dispose d on the same side of s aid photosensitive drum; and said first cartridge guiding portion and said second cartridge guiding portion extend in a longitudinal direction of said photosensitive drum in the form of a drum.

15. An electrophotographic image forming apparatus for forming an image on a recording material, to which a process cartridge is detachably mountable, said apparat us comprising:

(i) a main assembly side guide;

(ii) mounting means for detachably mounting a process cartridge, said process cartridge including:

a cartridge frame;

an electrophotographic photosensitive drum:

a developing roller for developing an electrostatic latent image formed on said photosensitive drum;

a charge member for electrically charging said photosensitive drum;

a first cartridge guiding portion for being guided by the main assembly guide provided in the main assembly of the apparatus when said process cartridge is mounted to the main assembly of the apparatus, said first cartridge guiding portion being provided at one end, with respect to a mounting direction in which said process cartridge is mounted to the main assembly of apparatus, of said cartridge frame;

a second cartridge guiding portion for being guided by a main assembly guide provided in the main assembly of the apparatus when said process cartridge is mounted to the main assembly of apparatus, said second cartridge guiding portion being provided at the other end, with respect to the mounting direction, of said cartridge frame, wherein said first cartridge guiding portion and said second cartridge guiding portion project in directions substantially perpendicular to a longitudinal direction of said process cartridge, and wherein when said process cartridge is mounted to the main assembly of the apparatus, said first and second cartridge guiding portions are at different heights; and a driving force receiving portion for receiving from the main assembly of the apparatus a driving force for rotating said photosensitive drum, said driving force receiving portion being provided at a leading end portion, with respect to the mounting direction, wherein when a plurality of such process cartridges are mounted to the main assembly of said apparatus, said process cartridges are juxtaposed with each other with said first cartridge guiding member of one of the juxtaposed process cartridges and said second cartridge guiding member of the other of the juxtaposed process cartridges being adjacent to each other, and wherein said first cartridge guiding portion and said second cartridge guiding portion are projected outwardly from said cartridge frame and extend in the mounting direction, wherein said first cartridge guiding portion and said second cartridge guiding portion are extended from a trailing side of said cartridge frame toward a leading side thereof with respect to the mounting direction, and wherein said first cartridge guiding portion and a developing roller as said process means are disposed on the same side of said photosensitive drum; said second cartridge guiding portion and a charging member as said process means are disposed on the same side of said photosensitive drum; and said first cartridge guiding portion and said second cartridge guiding portion extend in a longitudinal direction of said photosensitive drum in the form of a drum.

16. An apparatus according to claim 9, 10 or 15 wherein said main assembly guide comprises a first main assembly guiding portion for guiding said first cartridge second portion of said process cartridge which is disposed juxtaposed with another said cartridge, and a second main assembly guiding portion for guiding said second cartridge guiding portion, and wherein said first main assembly guiding portion is provided at one surface of said main assembly guide, and said second main assembly guiding portion is provided at a backside of said main assembly guide.

* * * * *

UNITED STATES PATENT AND TRADEMARK OFFICE

CERTIFICATE OF CORRECTION

PATENT NO. : 6,463,233 B2
DATED : October 8, 2002
INVENTOR(S) : Hisayoshi Kojima et al.

It is certified that error appears in the above-identified patent and that said Letters Patent is hereby corrected as shown below:

Column 2,
Line 12, “above described” should read -- above-described --.

Column 3,
Line 12, “cartridge” should read -- cartridge. --.

Column 4,
Line 20, “Intermediary” should read -- intermediary --.

Column 8,
Line 27, “above described” should read -- above-described --.

Column 9,
Line 62, “above described” should read -- above-described --.

Column 10,
Line 16, “cross sectional” should read -- cross-sectional --.
Line 43, “above described” should read -- above-described --.

Column 16,
Line 18, “member” should read -- member; --.
Line 49, “apparatus,” should read -- said apparatus, --.

Column 17,
Line 1, “developer” (second occurrence) should be deleted.
Line 2, “remaining on said” should be deleted.
Line 6, “frame:” should read -- frame; --.
Line 19, “frame” should read -- frame; --.
Line 20, “second” should read -- a second --.
Line 23, “apparatus,” should read -- said apparatus, --.

Column 18,
Line 47, “member:” should read -- member; --.

Column 19,
Line 1, “potion” should read -- portion --.
Line 26, “frame:” should read -- frame; --.
Line 39, “frame” should read -- frame; --.

UNITED STATES PATENT AND TRADEMARK OFFICE

CERTIFICATE OF CORRECTION

PATENT NO. : 6,463,233 B2
DATED : October 8, 2002
INVENTOR(S) : Hisayoshi Kojima et al.

It is certified that error appears in the above-identified patent and that said Letters Patent is hereby corrected as shown below:

Column 20,
Line 9, “dispose d” should read -- disposed --; and “s” should be deleted.
Line 10, “aid” should read -- said --.
Line 16, “apparat us” should read -- apparatus --.
Line 22, “drum:” should read -- drum; --.

Column 22,
Line 1, “claim 9, 10” should read -- claim 12, 13 --.
Line 3, “first cartridge second portion” should read -- first cartridge guiding portion --.

Signed and Sealed this

Twenty-ninth Day of April, 2003

JAMES E. ROGAN
*Director of the United States Patent and Trademark Office*